US005316058A

United States Patent [19]

Spektor et al.

[11] Patent Number: 5,316,058

[45] Date of Patent: May 31, 1994

[54] CONTAINER HAVING A SELF-OPENING POURING SPOUT

[76] Inventors: Semyon Spektor, 766 33rd Ave.; Mark Gozokhovsky, 490 33rd Ave. #206, both of San Francisco, Calif. 94121

[21] Appl. No.: 944,960

[22] Filed: Sep. 15, 1992

[51] Int. Cl.[5] ..... B65D 25/08

[52] U.S. Cl. ..... 141/319; 141/329; 141/330; 141/309; 141/320; 222/83.5; 222/541; 222/81

[58] Field of Search ..... 141/309, 310, 329, 330, 141/319–322; 222/83, 83.5, 88, 522, 532, 541, 81

[56] References Cited

U.S. PATENT DOCUMENTS

| | | | |
|---|---|---|---|
| 2,667,986 | 2/1954 | Perelson | 141/329 X |
| 2,687,828 | 8/1954 | Horrocks | 141/329 X |
| 2,687,829 | 8/1954 | Horrocks | 222/83 |
| 3,310,206 | 3/1967 | Littlefield | 222/541 |
| 4,614,437 | 9/1986 | Buehler | 141/329 X |
| 4,651,885 | 3/1987 | Gach | 222/541 X |
| 4,723,687 | 2/1988 | Kutterer | 222/83 |
| 4,969,491 | 11/1990 | Kiplinger | 141/319 X |
| 5,072,762 | 12/1991 | Jimenez | 141/329 |
| 5,186,323 | 2/1993 | Pfleger | 222/83 X |
| 5,222,530 | 6/1993 | Baker et al. | 141/330 X |
| 5,228,592 | 7/1993 | Pelleano | 222/83 |

FOREIGN PATENT DOCUMENTS

| | | | |
|---|---|---|---|
| 11678 | of 1907 | United Kingdom | 141/310 |
| 587073 | 4/1947 | United Kingdom | 141/310 |

*Primary Examiner*—Ernest G. Cusick

[57] ABSTRACT

A container having a pouring spout for pouring oil into an engine (14). The container has a cap (24) which is screwed onto a neck portion (16) of the container. The cap (24) has radial ribs (32) tapering toward the cap bottom (28). The end of the neck portion (20) has a reduced diameter and is aligned with a breakable portion (28*a*) formed in the cap bottom. In use, the container is inserted in an inverted position so that the spout attends into an inlet opening (11) of the engine. Radial ribs (32) are wedged in the inlet opening by applying an axial force to the container body (10), and the body is then rotated with respect to the immovable cap (24). As a result of this rotation, the reduced-diameter portion (20) of the container neck moves axially toward the breakable portion (28*a*) until the portion (20) breaks it, thus opening the container and allowing the oil to flow into the engine oil tank (14). Provision of ribs (32) forms air gaps (34) between the outer surface of the cap (24) and the inlet opening (11). This accelerates outflow of the oil. A part of the breakable portion (28*a*) remains with an increased thickness, so that the broken portion does not fall into the oil tank of the engine but remains connected to the container. The oil filling operation is clean, and the used container can be conveniently discarded as a single unit. In the second embodiment, a cap (24*a*) is snapped on a neck portion of the container, and the axial displacement of a container body (10*a*), which breaks a bottom portion (29), is performed manually, i.e., without the use of threads.

3 Claims, 3 Drawing Sheets

CONTAINER HAVING A SELF-OPENING POURING SPOUT

BACKGROUND

1. Field of the Invention

The present invention relates to containers for liquid material, particularly, to containers with pouring spouts for dispensing liquids from the container in an inverted position into a receiving tank.

2. Description of Prior Art

The efficient delivery of oil to the inlet of a vehicle's engine is difficult to achieve in practice, in view of the complexity of automobile engines which often have poorly-accesible oil inlets. Thus, it is difficult to avoid spilling or dripping of oil onto adjacent engine parts and the ground; this mars engines' appearance and contaminates the environment.

Most often the engine's oil sump is filled with oil by using an oil container with a removable threaded cover. The oil is poured into the engine through an oil-filling port directly or via a funnel. A user holds the funnel in one hand and the oil container in another hand. Because of its high viscosity and the need to let air into the container, the oil flows slowly and in spurts. Since the funnel blocks the flow of air to the oil tank, the user often raises the funnel to form an air gap between the funnel and the oil inlet hole of the engine.

Upon completion of the oil pouring operation, three dirty, oily parts remain, i.e., a funnel which has to be kept in the car trunk, an empty oil container, and a threaded cover. The funnel must be cleaned and wiped, while the container and its cover must be discarded.

The pouring operation described above is inconvenient, requires two-hands, leaves the user with dirty hands, causes splashing of oil, and is disadvantageous from the environmental point of view.

U.S. Pat. No. 4,979,655, issued December 1990 to D. Gallucci, describes a pouring spout which is screwed onto a threaded neck of an oil container for pouring in an inverted position. The spout has a tubular shape, one end of which is connected to the oil container and the other of which has a dispensing opening and a closure sleeve. The closure sleeve is slidingly moveable between a first position, in which the dispensing opening is blocked, and a second position, in which the dispensing opening is open.

Since the closure sleeve is slidingly fitted onto the tube, the connection between the closure sleeve and the tube is not sealed against leakage of oil.

The assembly of a container with the pouring spout consists of three separate parts, i.e., the container, the tubular portion, and the closure sleeve. The pouring spout is complicated in structure, expensive to manufacture, and the presence of a long tubular portion increases the length of the spout as a whole.

The same patent discloses another embodiment in which the closure sleeve and the tube have a bayonet joint in the form of a pin, pressed into the tube, and an angular slot, formed in the closure sleeve. This embodiment requires an additional assembly operation of pressing the pin into the tube.

OBJECTS AND ADVANTAGES OF THE INVENTION

It is therefore an object of the invention to eliminate the above disadvantages and to provide a container having a pouring spout in which the connection between the closure sleeve and the tube is sealed against oil leakage, which consists only of two parts, which is simple in construction, convenient to use, inexpensive to manufacture, which is short in length, which remains assembled after the use and therefore convenient for discarding, and which is manufactured without additional assembly operations.

Other advantages and features of the invention will become apparent from a consideration of the ensuing description and drawings.

DETAILED DESCRIPTION OF THE POURING CONTAINER OF THE INVENTION

Figure 1:
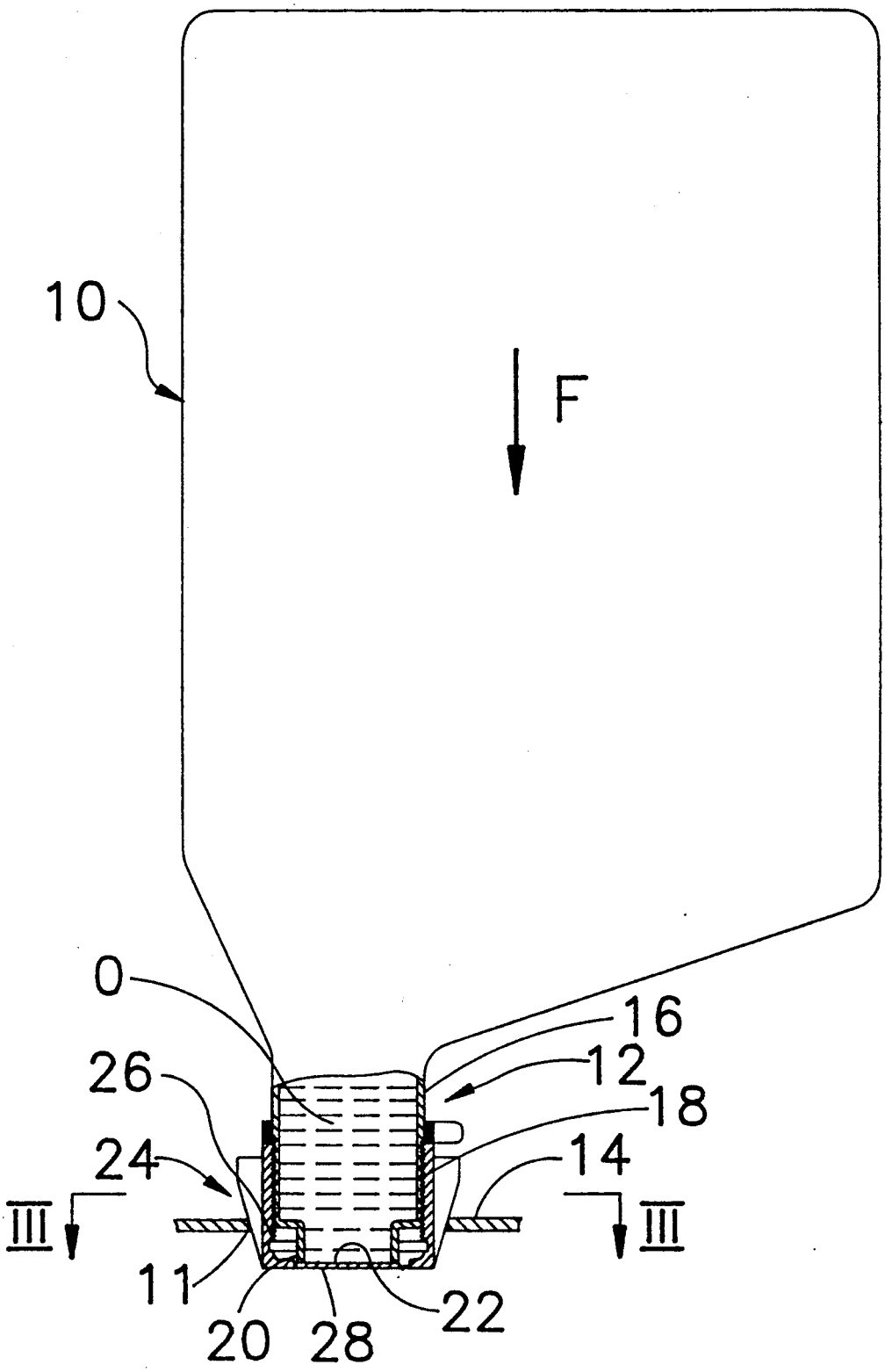
FIG. 1 is a pouring container of the invention in an overturned position with spout inserted into an inlet opening of the engine-oil tank for dispensing the oil into the tank.

FIG. 1 shows a pouring container of the invention in an inverted position with its spout inserted into an inlet opening 11 of an engine's valve cover (hereinafter engine) 14 for dispensing the oil into the sump of the engine by gravity via the usual valve housing and oil galleries and passages.

The pouring container consists of a container body 10 and a pouring spout 12. Container body 10 contains a material to be dispensed, e.g., engine oil O. The container body may be made of glass, but is preferably molded from a plastic material, such as polyethylene or the like, normally used for conventional oil-containing bottles or containers.

Spout 12 has a cylindrical neck portion 16 with an external thread 18. At its end, neck portion 16 has a reduced-diameter portion 20 which has an opening 22. Spout 12 also has a cap 24 with an internal thread 26 which engages external thread 18, and is closed by a breakable bottom portion 28. Bottom portion 28 is thinner than the walls of container body 10 and neck portion 16 to the extent that bottom portion 28 can be broken if an axial force F is applied to this portion from reduced-diameter portion 20. Such an axial force is developed when body 10 is rotated with respect to cap 24 so that external thread 18 engages internal thread 26 of cap 24 when the latter is fixed against rotation, i.e., when body 10 moves with respect to cap 24 in the direction of force F.

Figure 2:
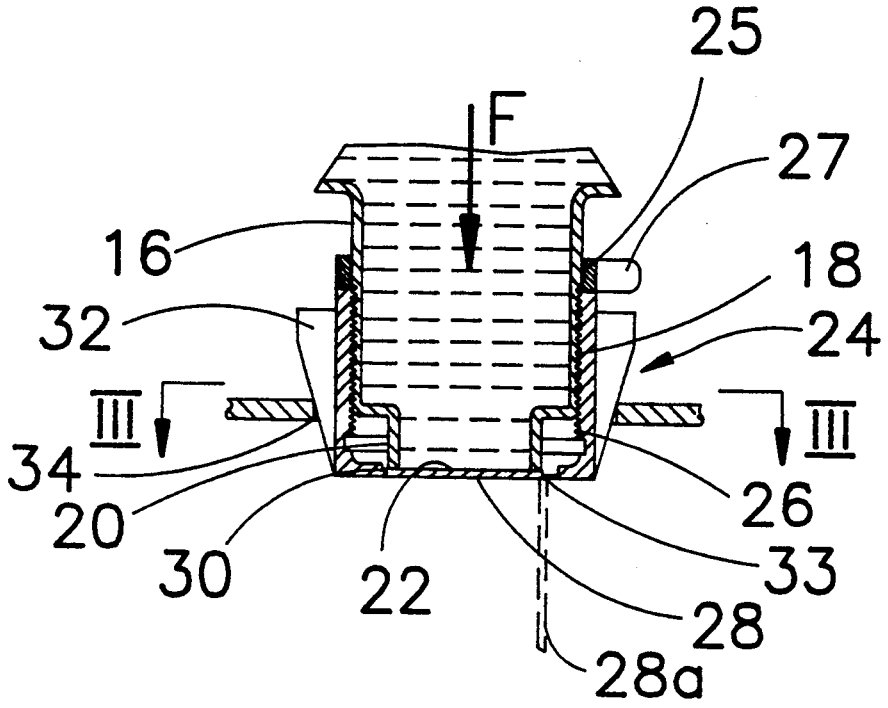
FIG. 2 is a fragmental view of the end of a cap shown on a larger scale.

FIG. 2 is a fragmental view of the end of cap 24 shown on a larger scale. To facilitate opening of cap 24, its bottom portion 28 may be prescored as shown by a groove 30. In order to prevent broken portion **28*a* (which is shown in FIG. 2 by phantom lines) from falling into engine 14, groove 30 does not form a complete circle but contains a portion 33, e.g., 1/10 of the circle, unscored, so that after opening cap 24, and hence of the container, portion 28a remains attached to the cap and does not fall into engine 14. This also means that an additional oily part, i.e., broken portion 28a**, is not separated from the container and is left connected thereto when after use the container is discarded.

Figure 3:
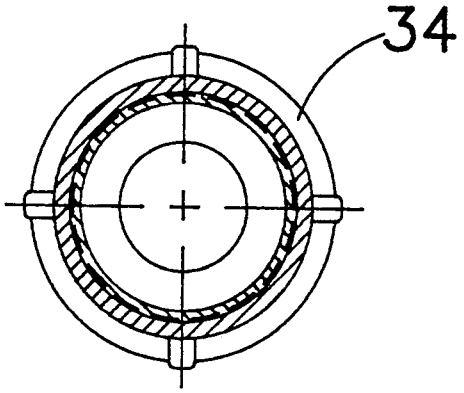
FIG. 3 is a sectional view taken along lines III—III in FIG. 1.

As shown in FIGS. 1 and 2, cap 24 has radial ribs 32 which taper from the body portion toward bottom portion 28 of the cap. Four such ribs are shown in FIG. 3, which is a sectional view taken along lines III—III in FIG. 1. Ribs 32 fulfill two functions: they stabilize the container when it is inserted into opening 11 of engine 14 and they form gaps 34 between the edges of opening 11 and cap 24 for allowing air to leave the engine, thus accelerating the oil dispensing operation.

After container body 10 is filled with oil O in a factory, cap 24 is threaded onto external thread 18 of the body and the connection is sealed in the same manner as a conventional oil container, e.g., with the use of a separatable sealing band 25 which forms a closed ring-like sealing layer around the joint between cap 24 and the threaded portion 18 of the container. Band 25 has a tag 27 which, when pulled, breaks sealing band 25 and makes it possible to separate it from cap 24 and container neck 16.

In a sealed state the container is ready for storage, transportation, and use.

Figure 2A:
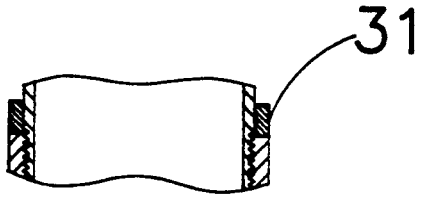
FIG. 2A is the same as FIG. 2, but with a self-breakable sealing band.

If necessary, a sealing band 31 of the type show in FIG. 2A can be used in conjunction the threaded neck portion and threaded neck. Sealing band 31 is the same as the one shown in FIG. 2, with the exception that it has no tag 27 and that the sealing band can be broken automatically when the container body is turned with respect to cap 24.

OPERATION OF CONTAINER WITH THREADED CAP

Prior to use, the oil container is unsealed by pulling tag 27 and breaking sealing band 25. After removing sealing band 25, it becomes possible to rotate cap 24 with respect to container body 10.

For filling the sump of engine 14 with oil, opening 11 is opened, the container is inverted, and its spout 12 is inserted into opening 11 so that ribs 32 are centered on the edges of opening 11 and form gaps 34 therewith. Gaps 34 connect the surrounding atmosphere with the interior of tank 14. A slight pressure is then applied to container body 10 to wedge ribs 32 in opening 11 and thus fix spout 12 immovably with respect to tank 14 with a force sufficient to keep cap 24 stationary when container body 10 is rotated.

Body 10 is then rotated in a clockwise direction which causes axial displacement of body 10 in the direction of the arrow designating force F (FIG. 1), i.e., body 10 is displaced towards opening 11. As body 10 is rotated, external thread 18 of the body engages stationary internal thread of 26 of 12, and body 10 moves axially in the direction of arrow F. This movement is continued until reduced-diameter portion 20 breaks thinned breakable portion 28 of cap 24.

Further movement of body 10 will develop force F acting in the direction of the arrow in FIG. 1. Since portion 28 is thinner than walls of body 10 and since scoring groove 30 is formed in portion 28, force F will break portion 28 along scoring groove 30, so that broken portion 28 will assume the position shown by phantom lines in FIG. 2. As a result, the container will be opened and oil (not shown) will pour out into engine 14. The presence of air gaps 34 will accelerate the flow of the viscous oil from the container into the tank. The hands of the user will remain clean and do not come into contact with oil or dirty parts. Broken part 28a will remain attached to cap 24 at unbroken portion 33. As a result, upon completion of the filling operation, the empty container will remain integrally connected to all parts, i.e., to cap 24 and broken portion 28a. This facilitates disposal of the used container.

When the operation is completed, the user pulls container body 10 upwardly and disconnects spout 12 from opening 11. The container is then discarded.

In the case of the embodiment of FIG. 2A, rotation of body 10 with respect to stationary cap 24 automatically breaks sealing band 31 and thus unseals the container, allowing further rotation of the container body with respect to cap 24.

FIG. 4—EMBODIMENT OF POURING CONTAINER WITHOUT THREADED PARTS

Figure 4:
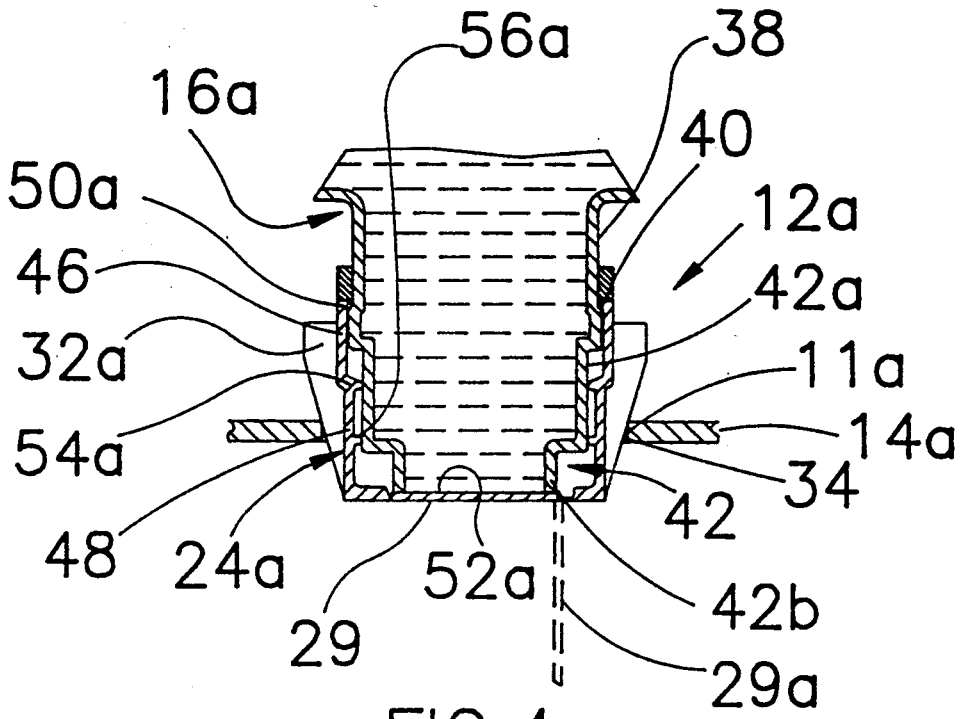
FIG. 4 is a fragmental view of a cap portion of a pouring container made in accordance with another embodiment of the invention with a two-step, reduced-diameter portion.

Another embodiment of the pouring container is shown in FIG. 4 in a fragmental view. In this embodiment, a portion of the cap can be broken, and thus the container can be opened without the use of threaded parts and without rotation of the container body.

Figure 5:
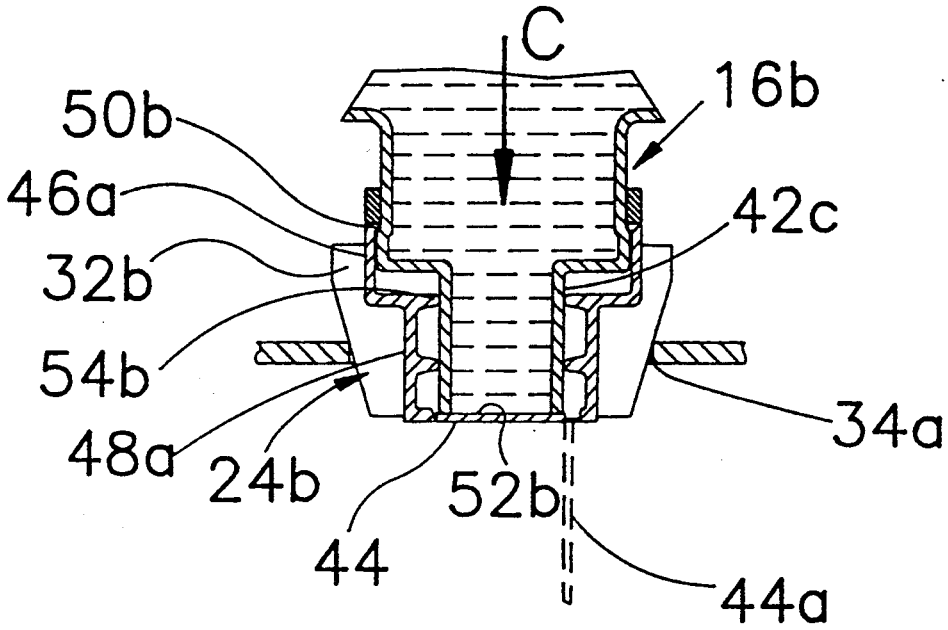
FIG. 5 is the same view as in FIG. 4 with a single-step reduced-diameter portion.

A container of this embodiment has a spout 12a which is shown in FIG. 4. As in the previous embodiment, the body terminates in a neck portion 16a. Neck portion 16a comprises a main cylindrical part 38 which has an annular shoulder 40 of a diameter larger than main cylindrical part 38 of neck portion 16a. The very end of neck portion 16a may have a small-diameter part 42, the diameter of which is smaller than that of the main part 38. The embodiment of FIG. 4 shows a two-step small-diameter part 42 which consists of a portion 42a and 42b, while FIG. 5 shows a neck portion 16b with a single-step small-diameter part 42c. The above-mentioned steps have diameters decreasing toward the end of neck portion 16a or 16b. In general, the embodiments of FIGS. 4 and 5 are identical and differ only in that one of them (FIG. 4) has a two-step small-diameter portion and another has a single-step small-diameter portion 42c. The operation of both versions is identical. Therefore, in most cases reference will be made to FIG. 4 only, although it is assumed that the description relates to identical parts of FIG. 5 as well.

Neck portion 16a or 16b is closed with a cap 24a or 24b, respectively. The cap is cup-shaped, has a closed end or bottom portion 29 (for neck portion 16a) or 44 (for neck portion 16b). Cap 24a or 24b has a large-diameter part 46 or 46a, respectively, and a small-diameter part 48 or 48a, respectively.

Large-diameter part 46 or 46a of cap 24a or 24b is longer, e.g., by $\frac{1}{8}$ to $\frac{1}{4}$ of its length in the axial direction of the container, than respective large-diameter part 40 or 40a of the neck portion.

Similar to the embodiment of FIGS. 2 and 3, caps 24a and 24b have radial ribs 32a and 32b which taper toward the end of the neck portion. The open end of cap 24a or 24b has inner projections 50a or 50b, respectively. An inner diameter between the projections being smaller than an outer diameter of large-diameter part 46a or 46b of neck portion 16a or 16b, so that cap 24a or 24b can be snapped onto neck portion 16a or 16b.

An axial distance from inner projections 50a or 50b to inner surface 52a or 52b of bottom portion 29 or 44 is equal to or slightly larger than a distance from the upper end of large-diameter part 40 or 40a to the end of small-diameter part 42b or 42c, respectively. As a result, when cap 24a or 24b is put onto container neck portion 16a or 16b and pushed down, bead or projection 50a or 50b is snapped on large-diameter part 40 or 40a of neck portion 16a or 16b and keeps the cap in a fixed position on the container. When cap 24a or 24b is snapped on the container neck, the end of small diameter portion 42b or 42c is either contact bottom portion 29 or is spaced from it at a distance which is shorter than the difference between the length of large-diameter part 46 or 46a of the cap and large-diameter part 40 and 40a of the neck portion.

Bottom portion 29 or 44 may have a circular scoring groove 30a or 30b of a diameter equal to or greater than small-diameter part 42b or 42c of neck portion 16a or 16b, respectively.

In the embodiment of FIG. 4, small-diameter part 48 of cap 24a also has inner projections 54a and 56a which, in the closed position of cap 24a, are in contact with the outer surface of small-diameter part 42a. In a similar manner, in the embodiment of FIG. 5, inner projections 54b and 56b are formed on the inner surface of small-diameter part 48a of cap 24b and are in contact with the outer surface of small-diameter part 42c of neck portion 16b.

A sealing band 25a or 25b of the same type as sealing band 25 of the previous embodiment is used in embodiments of FIGS. 4 and 5 for sealing containers closed with caps 24a and 24b. Sealing band 25a or 25b is located on neck portion 16a or 16b of the container body just above the upper end face of cap 24a or 24b, i.e., above inner projections 50a or 50b.

FIGS. 4 and 5—OPERATION OF CONTAINERS WITH SNAPPED-ON CAPS

Since the oil-filling spouts of FIGS. 4 and 5 are identical in their operation, reference will be made generally to FIG. 4, although it is assumed that the explanation of the operation relates to the embodiment of FIG. 5 as well.

For filling engine 14 with oil, engine 14a is opened, the container is inverted, and its spout 12a is inserted into inlet opening 11a of engine 14a so that ribs 32 are centered on the edges of oil tank inlet opening 11a and form gaps 34a between opening 11a and the outer surface of cap 24a. Gaps 34 connect the surrounding atmosphere with the interior of tank 14a. A slight pressure is then applied to container body 10a to wedge ribs 32a in opening 11a and thus fix spout 12a immovably with respect to tank 14a with a force sufficient to keep cap 24a stationary when container body 10a is shifted further downwardly in the axial direction.

A force C which is directed downward is then applied manually to container body 10a. This force, which is within the range of 0.75 to 1.50 kg, causes axial displacement of body 10a in the direction of arrow C, i.e., body 10a is displaced towards opening 11a. As body 10a moves downward, it breaks sealing band 25a and unsnaps inner projections 50a from the recess formed by the shoulder of large-diameter part 40. Since the lower end face of small-diameter portion 42b of body 10a of FIG. 4 (or small-diameter portion 42c of container body 10b of FIG. 5) is in contact with bottom portion 29 (or 44 in cap 24b), further axial movement of body 10a or 10b will break prescored or thinned breakable parts of bottom portions 29 or 44.

As a result, the container is opened and oil (not shown) will pour out into tanks 14a or 14b. Since, as has been mentioned above, large-diameter part 46 or 46a of cap 24a or 24b is longer than respective large-diameter part 40 or 40a of the neck portion, it will have an axial stroke sufficient for breaking the breakable part of the bottom portion of the cap. If the container body is moved further after opening the container, the lower shoulder of large diameter portion 40 or 42 will rest on the upper shoulder of small-diameter part, so that further movement of container body 10a or 10b will be impossible.

The presence of air gaps 34a will accelerate the flow of the viscous oil from the container into the tank. The hands of the user will remain clean and do not come into contact with oil or dirty parts. Broken part 29a or 44a will remain attached to cap 24a or 24b at unbroken portion 33a or 33b. As a result, upon completion of the filling operation, the empty container will remain integrally connected to all parts, i.e., to cap 24a and broken portion 29a or 44a. This facilitates disposal of the used container.

When the operation is completed, the user pulls container body 10a or 10b upwardly and disconnects pouring element 12a or 12b from opening 11a or 11b. The container with its cap still attached is then discarded in a one-step operation.

SUMMARY, RAMIFICATIONS, SCOPE

Thus, it has been shown that we have provided a container having a pouring spout in which the connection between the closure sleeve and the tube is sealed against oil leakage, which consists only of two parts, which is simple in construction, inexpensive to manufacture, is short in length, remains assembled after use and therefore is convenient for discarding, and which is manufactured without additional assembling operations.

Although the oil-filling container has been shown and described in the form of one specific embodiment, this embodiment, its parts, materials, and configurations have been given only as examples, and many other modifications of the container are possible. For example, the container body may contain liquids other than oil, the container body may have different configurations, the number of ribs 32 may be other than four, etc. The breakable portion may be only prescored without having a reduced thickness. A very thin bottom portion may be used in the cap instead of prescoring. The sealing band may be replaced by crimping, by a layer of a sealing substance, etc.

Therefore, the scope of the invention should be determined, not by the example given, but by the appended claims and their legal equivalents.

What we claim is:

1. A container having a pouring spout for pouring a liquid contained in said container into a liquid-receiving tank having an inlet opening, said container comprising:

a container body with a cylindrical neck portion having an opening;

a cap which is connected to said container and has an outer surface, and a bottom portion, said cap being sealingly attached to said neck portion;

radial ribs on the outer surface of said cap for forming an air gap between said cap and said inlet opening, said radial ribs tapering in the direction away from said container body toward said cap;

a breakable portion in said cap which, when broken, opens said container, said breakable portion being a portion of said bottom portion of said cap which has a reduced thickness; and breaking means on said cylindrical neck portion for breaking said breakable portion, said breaking means comprising a portion of a reduced diameter on the end of said neck, said opening being formed in said portion of a reduced diameter;

a part of said breakable portion having a thickness greater than said reduced thickness, so that after breaking said breakable portion, it remains attached to said cap, said breakable portion being prescored at least on a part of its surface;

said container body being filled with a liquid and connection of said cap with said neck portion being sealed with a breakable sealing member in a form of a sealing band which in a sealing state forms a ring-shaped seal around said connection.

2. The container of claim 1 wherein said cylindrical neck portion has a large-diameter part of a predetermined length in an axial direction of said container and at least one small-diameter part at the end of said neck portion, said cap has a large-diameter part which, in a closed position of said container, embraces said large-diameter part of said neck portion and has a length greater than said predetermined length, in said closed position said end of said neck portion is located at a distance from said bottom portion which is smaller than the difference between said lengths so that with the axial movement of said cylinder body toward said cap said bottom portion can be broken.

3. The container of claim 2 wherein said cap has first inner projections on the inner surface of said large-diameter portion, an inner diameter between said projections being smaller than an outer diameter of said large-diameter portion of said neck portion, so that said cap can be snapped onto on said neck portion.

* * * * *